US010065827B2

(12) United States Patent
Takaba

(10) Patent No.: US 10,065,827 B2
(45) Date of Patent: Sep. 4, 2018

(54) CONVEYANCE APPARATUS

(71) Applicant: CANON KABUSHIKI KAISHA, Tokyo (JP)

(72) Inventor: Ryo Takaba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 15/648,170

(22) Filed: Jul. 12, 2017

(65) Prior Publication Data

US 2018/0029821 A1 Feb. 1, 2018

(30) Foreign Application Priority Data

Jul. 29, 2016 (JP) ..... 2016-150424

(51) Int. Cl.

| | |
|---|---|
| ***B65H 29/60*** | (2006.01) |
| ***B65H 43/00*** | (2006.01) |
| ***B65H 29/12*** | (2006.01) |

(52) U.S. Cl.

CPC ..... *B65H 29/60* (2013.01); *B65H 29/125* (2013.01); *B65H 43/00* (2013.01); *B65H 2555/23* (2013.01); *B65H 2557/352* (2013.01); *B65H 2601/11* (2013.01)

(58) Field of Classification Search

CPC .. B65H 2404/7414; B65H 5/36; B65H 29/58; B65H 29/60; B65H 2404/45; B65H 2555/13; B65H 2555/132; B65H 2555/134; B65H 2555/23; G03G 21/1633

See application file for complete search history.

(56) References Cited

U.S. PATENT DOCUMENTS

| | | | | |
|---|---|---|---|---|
| 9,665,812 | B2 * | 5/2017 | Hara | G06K 15/4085 |
| 9,682,836 | B2 * | 6/2017 | Kowase | B65H 29/60 |
| 2010/0213661 | A1 * | 8/2010 | Fukazawa | B65H 29/58 271/3.19 |
| 2015/0362865 | A1 * | 12/2015 | Lee | G03G 15/14 399/395 |
| 2016/0054697 | A1 * | 2/2016 | Tanaka | G03G 15/6573 399/21 |

FOREIGN PATENT DOCUMENTS

| | | | |
|---|---|---|---|
| JP | 06-37250 | U | 5/1994 |
| JP | 07291509 | A | * 11/1995 |
| JP | H07291509 | A | 11/1995 |
| JP | 2005170639 | A | 6/2005 |
| JP | 2011241043 | A | 12/2011 |
| JP | 2016-105143 | A | 6/2016 |

* cited by examiner

*Primary Examiner* — Jeremy R Severson

(74) *Attorney, Agent, or Firm* — Canon U.S.A., Inc. IP Division

(57) ABSTRACT

A conveyance apparatus according to the disclosure includes a conveyance unit that conveys a sheet, a flapper movable between a first position and a second position, a flapper moving unit that moves the flapper to the first position when power is supplied, a door to open a predetermined conveyance path and a second conveyance path, a detection unit that detects an occurrence of an abnormal state relating to the conveyance apparatus, and a control unit that, in a case where the detection unit detects the occurrence of the abnormal state while a sheet is conveyed to the first conveyance path by the conveyance unit and the flapper is in the first position, stops a sheet conveyance operation of the conveyance unit and inhibits the flapper from moving to the second position by continuing to supply power to the flapper moving unit.

20 Claims, 10 Drawing Sheets

WHEN SOLENOID IS ON

WHEN SOLENOID IS OFF

WHEN INLET SENSOR 216 IS ON AND CONVEYANCE SENSOR 218 IS OFF

WHEN INLET SENSOR 216 IS OFF AND CONVEYANCE SENSOR 218 IS ON

CONVEYANCE APPARATUS

BACKGROUND OF THE INVENTION

Field of the Invention

The disclosure relates to control for switching a flapper in a conveyance apparatus that conveys sheets.

Description of the Related Art

A conveyance apparatus that sorts sheets to a plurality of sheet discharge bins is known as an example of a sheet discharge option apparatus which is used by being connected to an image forming apparatus. Such a conveyance apparatus has a flapper in a place where a conveyance path branches into a plurality of paths. The conveyance apparatus changes a conveyance destination of a sheet by switching a position of the flapper.

Japanese Patent Application Laid-Open No. 2011-241043 discusses a configuration in which a conveyance destination of a sheet received from an image forming apparatus is switched by a flapper, and a sheet discharge option apparatus that folds the conveyed sheets in half and book-binds them. The sheet discharge option apparatus is provided with a press unit that folds a sheet. The press unit is a pair of rollers that moves while nipping a folded sheet and applying pressure to it. The press unit moves along the width direction (direction perpendicular to the conveyance direction of sheets) of sheets.

According to Japanese Patent Application Laid-Open No. 2011-241043, in a case where a sheet jam (paper clogging) occurs during bookbinding processing, the press unit is moved to its home position. Then, the sheet jam is notified. The home position is a position outside the conveyance path in the width direction of sheets. The press unit in the home position does not hinder removal of jammed paper when a user removes the jammed paper remaining inside the apparatus. This reduces burden of the user when a sheet jam is cleared.

Many of the conventional conveyance apparatuses switch a position of a flapper by operating a solenoid. The flapper moves to a first position when the solenoid is turned on and moves to a second position due to influence of an elastic member, such as a spring, when the solenoid is turned off. When the flapper is in the first position, a sheet is conveyed to a first conveyance path and discharged to a first sheet discharge bin. When the flapper is in the second position, a sheet is conveyed to a second conveyance path and discharged to a second sheet discharge bin. The flapper moved to the second position closes the first conveyance path to prevent a sheet from being conveyed to the first conveyance path.

The conventional conveyance apparatuses are configured such that power supply to the solenoid is stopped when a sheet jam occurs while a sheet is conveyed to the first sheet discharge bin, to save power consumption. When the solenoid is turned off, the flapper moves from the first position to the second position. This movement may cause the flapper to trap a sheet against the first conveyance path. In such a case, the flapper becomes an obstacle when jammed paper is removed.

The above-described issue also arises in a configuration in which the position of the flapper is switched by an actuator other than the solenoid, for example, a stepping motor. This is because if power supply to the stepping motor is stopped, the force retaining the flapper in the first position is lost and the flapper may move to the second position where the flapper traps a sheet under the influence of gravity or the like. A similar issue also arises when, in addition to the case of occurrence of a sheet jam, a sheet conveyance operation is forcibly stopped after a failure of the conveyance apparatus, such as door opening of the apparatus occurs.

In the Japanese Patent Application Laid-Open No. 2011-241043, the flapper is utilized for the configuration of switching the conveyance destination of sheets and the press unit is discussed for reducing burden of the user when a sheet jam is cleared. However, the flapper is not discussed for reducing burden of the user when a sheet jam is cleared.

SUMMARY OF THE INVENTION

The disclosure is directed to a conveyance apparatus in which a flapper that switches a conveyance direction of a sheet is inhibited from becoming an obstacle to a user to improve user usability when a sheet remaining inside the apparatus is removed.

According to an aspect of the disclosure, a conveyance apparatus includes a conveyance unit configured to convey a sheet along a predetermined conveyance path, a flapper configured to be movable between a first position and a second position, the flapper in the first position guiding a sheet conveyed by the conveyance unit from the predetermined conveyance path to a first conveyance path branched from the predetermined conveyance path, the flapper in the second position guiding a sheet conveyed by the conveyance unit from the predetermined conveyance path to a second conveyance path branched from the predetermined conveyance path, a flapper moving unit configured to move the flapper to the first position when power is supplied to the flapper moving unit, wherein when power supply to the flapper moving unit is stopped, the flapper moves to the second position, a door configured to open the predetermined conveyance path and the second conveyance path, a detection unit configured to detect an occurrence of an abnormal state relating to the conveyance apparatus, and a control unit configured to, in a case where the detection unit detects the occurrence of the abnormal state while a sheet is conveyed to the first conveyance path by the conveyance unit and the flapper is in the first position, stop a sheet conveyance operation of the conveyance unit and inhibit the flapper from moving to the second position by continuing to supply power to the flapper moving unit.

Further features and aspects of the disclosure will become apparent from the following description of various example embodiments with reference to the attached drawings.

DESCRIPTION OF THE EMBODIMENTS

Figure 1:
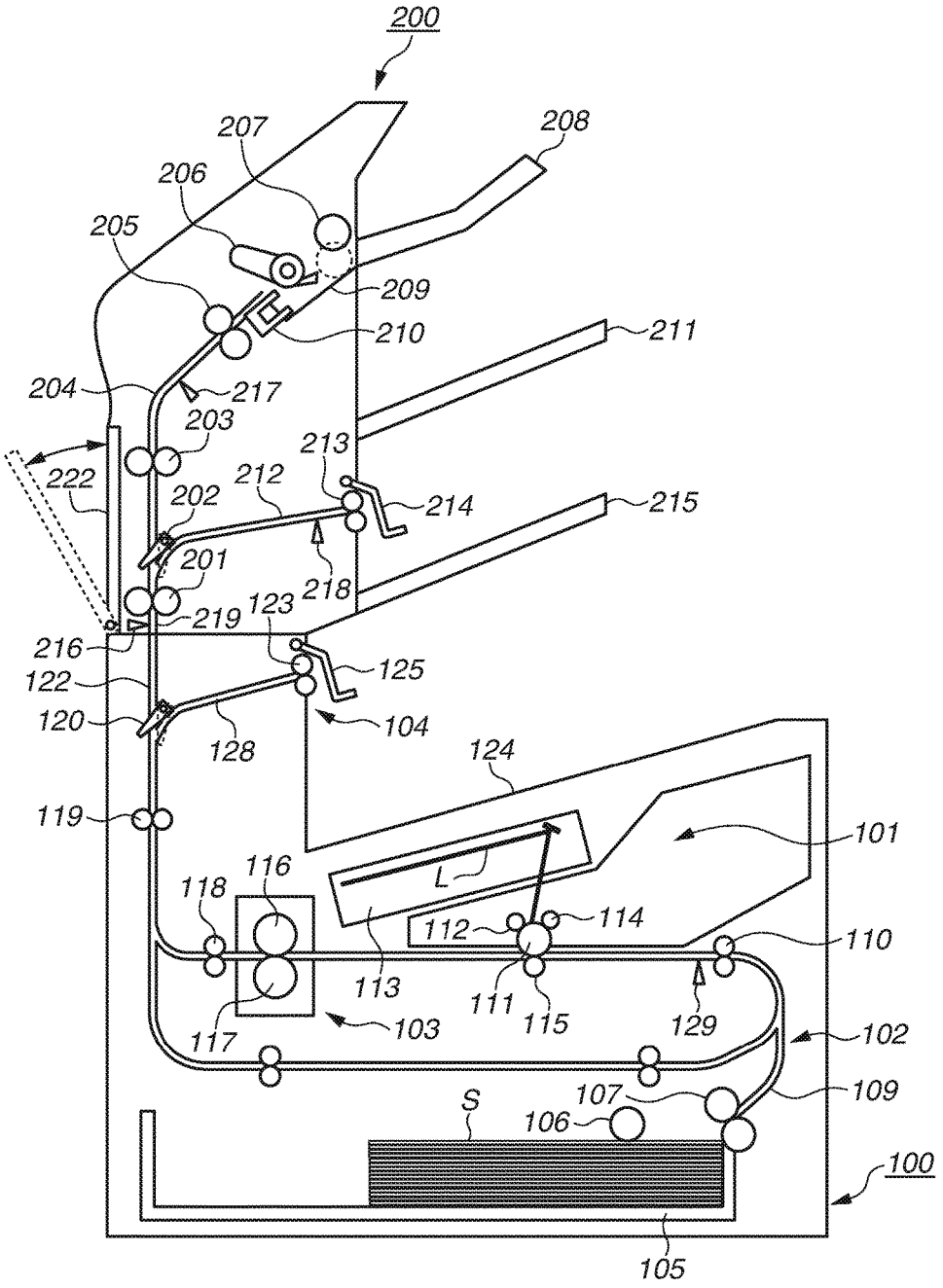
FIG. 1 is a sectional view of a laser beam printer including a sheet discharge option apparatus.

FIG. 1 is a view illustrating a schematic structure of a conveyance apparatus according to a first example embodiment of the disclosure. As an example of the conveyance apparatus according to the present example embodiment, the schematic structure includes a sheet discharge option apparatus which is used by being connected to an image forming apparatus. The schematic structure also includes a laser beam printer as an example of the image forming apparatus.

In FIG. 1, a laser beam printer 100 (hereinafter referred to as the printer 100) includes an image forming unit 101, a sheet feeding unit 102 that feeds a sheet S to the image forming unit 101, a fixing unit 103 that fixes an image formed on the sheet S, and a sheet discharge unit 104. The sheet S is recording paper (recording material) on which an image is formed. The printer 100 is provided with a sheet discharge option apparatus 200 that performs post-processing when needed on the sheet S on which an image has been formed. The sheet discharge option apparatus 200 is detachably attached on the upper side of the printer 100.

The image forming unit 101 includes a photosensitive drum 111 that rotates clockwise in FIG. 1, a charging roller 112 that charges the surface of the photosensitive drum 111, and an exposure apparatus 113 that forms an electrostatic latent image by irradiating the photosensitive drum 111 with light L. The image forming unit 101 further includes a developing roller 114 that forms a toner image by putting toner on an electrostatic latent image formed on the photosensitive drum 111 and a transfer roller 115 that transfers a toner image formed on the photosensitive drum 111 to the sheet S fed by the sheet feeding unit 102. The image forming unit 101 forms a toner image on the sheet S by image forming processing as described above. The fixing unit 103 includes a fixing roller 116, a pressure roller 117 in contact with the fixing roller 116 from below, and a fixing/discharge roller 118. The fixing roller 116 and the pressure roller 117 nip the sheet S to fix a toner image transferred to the sheet S on the sheet S by heat and pressure.

The sheet feeding unit 102 includes a cassette 105 on which a plurality of sheets S is stacked and a pickup roller 106 that feeds the sheet S stacked on the cassette 105. The sheet feeding unit 102 further includes a sheet feeding roller 107 that feeds the sheet S fed by the pickup roller 106 to a conveyance path 109. Furthermore, the sheet feeding unit 102 includes a top sensor 129 that detects the sheet S having passed through the conveyance path 109 and a registration roller 110 that conveys the sheet S to the image forming unit 101. According to the timing when the sheet S is detected by the top sensor 129, the formation of a toner image on the photosensitive drum 111 is started. Then, the sheet S is conveyed by the registration roller 110 to a transfer nip portion formed by the photosensitive drum 111 and the transfer roller 115 so that the sheet S and the toner image on the photosensitive drum 111 are synchronized with each other.

The sheet discharge unit 104 includes a flapper 120, a conveyance roller 119, a sheet discharge roller 123, a sheet discharge tray 124, and a full-state detection lever 125. The flapper 120 guides the sheet S to which an image has been fixed by the fixing unit 103 to the sheet discharge tray 124 or the sheet discharge option apparatus 200. The flapper 120 moves to a position indicated by a solid line in FIG. 1 to guide the sheet S to the sheet discharge tray 124, i.e., to a conveyance path 128. The flapper 120 moves to a position indicated by a broken line in FIG. 1 to guide the sheet S to the sheet discharge option apparatus 200, i.e., to a conveyance path 122. The flapper 120 is configured to be movable by an actuator (not illustrated). The sheet discharge tray 124 is provided on the top surface of the printer 100 and the sheet S conveyed by the conveyance roller 119 and the sheet discharge roller 123 is stacked thereon. When the full-state detection lever 125 detects a full state of the discharged sheets S, the printer 100 does not discharge the sheet S to the sheet discharge tray 124 until the sheets S on the sheet discharge tray 124 are removed.

Next, the configuration of the sheet discharge option apparatus 200 will be described with reference to FIG. 1. The sheet discharge option apparatus 200 according to the present example embodiment can sort and allocate the sheets S received from the printer 100 to a plurality of sheet discharge bins. The sheet discharge option apparatus 200 according to the present example embodiment can perform various types of post-processing, such as an alignment process and a staple process, on the sheet S.

The sheet S from the printer 100 is received and conveyed by an inlet roller pair 201. The presence or absence of the sheet S is detected by an inlet sensor 216 (sheet detection unit) on a conveyance path 219 (predetermined conveyance path). The conveyance path 219 is connected to the conveyance path 122 of the printer 100. A flapper 202 is provided in a place where the conveyance path 219 branches to a conveyance path 212 (first conveyance path) and a conveyance path 204 (second conveyance path) and guides the sheet S conveyed by the inlet roller pair 201 to the conveyance path 212 or the conveyance path 204. The flapper 202 moves to the position (first position) indicated by the solid line illustrated in FIG. 1 to guide the sheet S to the conveyance path 212. The flapper 202 moves to the position (second position) indicated by the broken line in FIG. 1 to guide the sheet S tot the conveyance path 204.

Figure 2A:
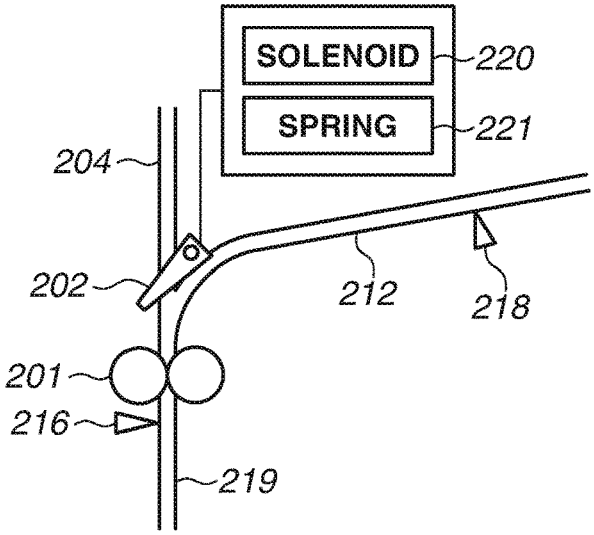
FIGS. 2A and 2B are enlarged sectional views around a flapper of the sheet discharge option apparatus.
Figure 2B:
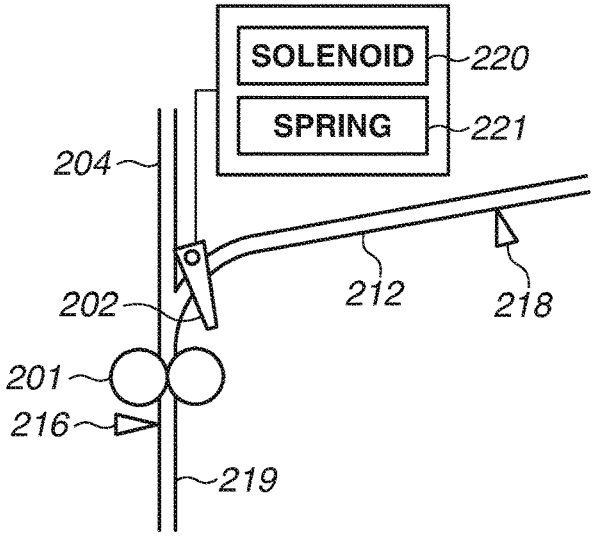

The operation of the flapper 202 will be described in detail with reference to FIG. 2. In the present example embodiment, the position of the flapper 202 is switched by operating a solenoid 220. FIG. 2A illustrates a state in which the solenoid 220 is on. The solenoid 220 turns on by power supply and operates, and then, moves the flapper 202 to the position illustrated in FIG. 2A against an elastic force of a spring 221 (elastic member). FIG. 2B illustrates a state in which the solenoid 220 is off. When power supply to the solenoid 220 is stopped, the flapper 202 moves to the position illustrated in FIG. 2B due to the elastic force of the spring 221. The solenoid 220 and the spring 221 are together defined as a flapper moving unit.

Figure 3:
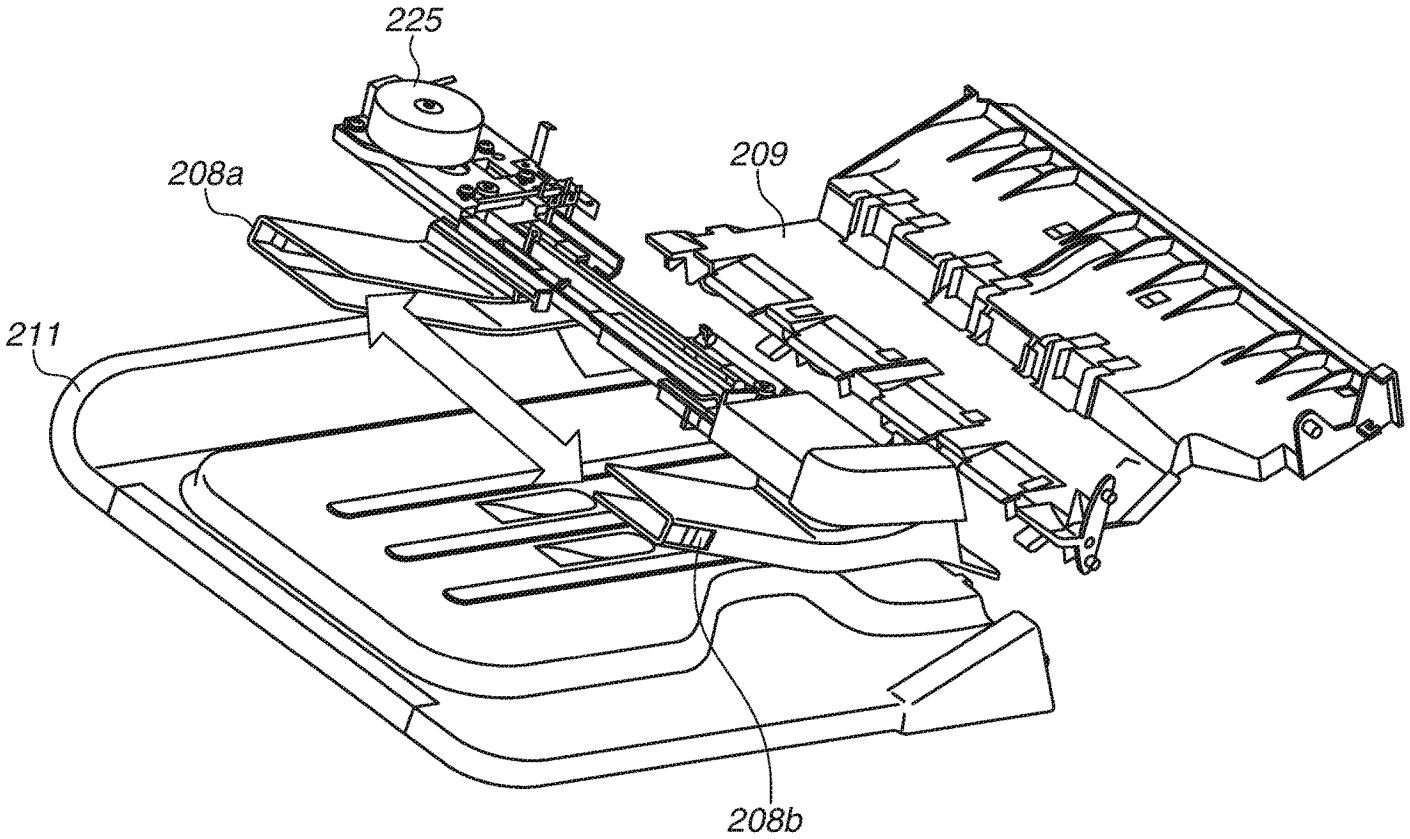
FIG. 3 is a perspective view of the sheet discharge option apparatus.

The configuration of the sheet discharge option apparatus 200 will be described with reference to FIG. 1. When the sheet S is guided in a direction of the conveyance path 204, the sheet S is conveyed by a conveyance roller 203 and a conveyance roller 205. The presence or absence of the sheet S is detected by a conveyance sensor 217 (sheet detection unit) on the conveyance path 204. In the downstream of the conveyance roller 205 in a conveyance direction of the sheet S, the sheet discharge option apparatus 200 includes an intermediate stack tray 209 that temporarily stores the sheet S. In the further downstream, the sheet discharge option apparatus 200 includes a jogger 208 that supports both ends in the width direction of the sheet S and aligns the position of the sheet S. The width direction of the sheet S is a direction parallel to the stacking face of the intermediate stack tray 209 and perpendicular to the conveyance direction of the sheet S. The jogger 208 includes, as illustrated in a perspective view of FIG. 3, a first aligning member 208*a* and a second aligning member 208*b* and is reciprocally moved by an aligning motor 225 in the width direction indicated by an arrow illustrated in FIG. 3 to align the position of the sheet S in the width direction. The sheet S conveyed by the conveyance roller 205 is stacked in a manner extending over the jogger 208 and the intermediate stack tray 209.

Above the intermediate stack tray 209, an aligning paddle 206 and a sheet discharge roller 207 are provided. The sheet discharge roller 207 is rotated by an actuator (not illustrated) and is able to come into contact with or separate from the sheet S stacked on the intermediate stack tray 209. A stapler 210 binds the ends of the sheets S stacked on the intermediate stack tray 209 and aligned by the jogger 208. Below the jogger 208 in the vertical direction, a sheet discharge tray 211 is provided. When the sheet discharge roller 207 comes into contact with the sheet S stacked on the intermediate stack tray 209 and rotates, and then the jogger 208 moves to a retreating position (details thereof will be described below), the sheet S stacked on the intermediate stack tray 209 is discharged to the sheet discharge tray 211.

Figure 4A:
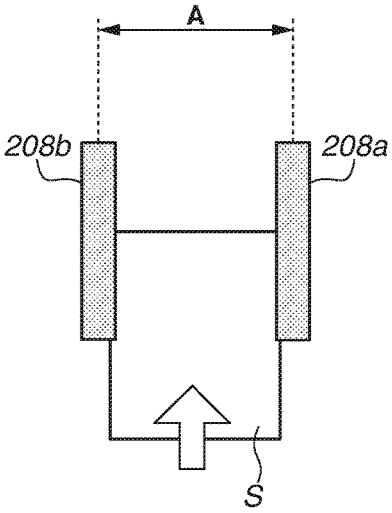
FIGS. 4A to 4C are diagrams illustrating movement of a jogger during a staple process.

A staple process of the sheet discharge option apparatus 200 will be described in detail below. When the staple process is performed, the flapper 202 moves to the position indicated by the broken line illustrated in FIG. 1 to guide the sheet S to the conveyance path 204. The sheet S guided to the conveyance path 204 is conveyed to the intermediate stack tray 209 by the conveyance roller 205. In this process, the sheet discharge roller 207 is in a position separated from the sheet S which is to be stacked on the intermediate stack tray 209. Before the sheet S is conveyed to the intermediate stack tray 209 by the conveyance roller 205, the jogger 208 moves to a position where the jogger 208 can receive the sheet S. This state is illustrated in FIG. 4A. FIG. 4A is a diagram illustrating the jogger 208 viewed from above in the vertical direction. The position where the jogger 208 can receive the sheet S is a state in which an interval between the first aligning member 208*a* and the second aligning member 208*b* is A. The interval A can be any interval which is longer than the length in the width direction of the sheet S and also is sufficient for the tip of the sheet S not to collide against the first and second aligning members 208*a* and 208*b* when the sheet S is conveyed by the conveyance roller 205. The first aligning member 208*a* and the second aligning member 208*b* are operated by the aligning motor 225 in a linked manner.

Figure 4B:
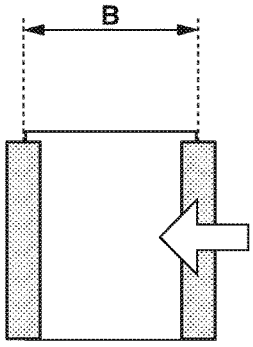

The sheet S stacked in a manner extending over the intermediate stack tray 209 and the jogger 208 is supported on both ends of the sheet S in the width direction by the jogger 208. More specifically, the first aligning member 208*a* comes into contact with one end in the width direction of the sheet S and the second aligning member 208*b* comes into contact with the other end in the width direction of the sheet S. Then, the jogger 208 moves along the width direction of the sheet S to align the position of the sheet S in the width direction. This state is illustrated in FIG. 4B. The position where the sheet S is aligned by the jogger 208 is a state in which the interval between the first aligning member 208*a* and the second aligning member 208*b* is B. The interval B is an interval shorter than the interval A. The interval B has a length same as the length in the width direction of the sheet S or a length longer than the length in the width direction of the sheet S by some margin.

In the present example embodiment, the second aligning member 208*b* is stopped at a reference position of alignment by a mechanical stopper (not illustrated) and only the first aligning member 208*a* moves in the width direction. In other words, the sheet S is aligned by being bumped against the second aligning member 208*b*.

After completion of the position alignment of the sheet S in the width direction by the jogger 208, the position in the conveyance direction is aligned by the aligning paddle 206. The aligning paddle 206 moves the sheet S stacked on the intermediate stack tray 209 to the side on which the stapler 210 is arranged and aligns the sheet S by bumping an edge of the sheet S against the stapler 210. This completes the alignment process when a sheet S is conveyed to the intermediate stack tray 209. If the job includes two sheets S or more on which the staple process is performed, the conveyance roller 205 conveys a subsequent sheet S to the intermediate stack tray 209. Then, the above alignment process is repeated.

Figure 4C:
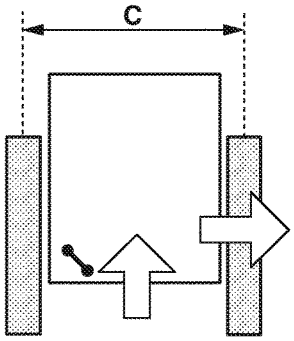

When a plurality of sheets S on which a staple process is performed is stacked on the intermediate stack tray 209 and the alignment process is performed by the jogger 208 and the aligning paddle 206, the stapler 210 performs the staple process on the plurality of sheets S. Then, the sheet discharge roller 207 moves to a position where the sheet discharge roller 207 is in contact with the sheet S stacked on the intermediate stack tray 209 and discharges a bundle of sheets S on which the staple process has been performed to the sheet discharge tray 211. In this process, the jogger 208 moves to the retreating position. This state is illustrated in FIG. 4C. The retreating position of the jogger 208 is a state in which the interval between the first aligning member 208*a* and the second aligning member 208*b* is C. The interval C is wider than the interval A. The interval C can be any interval at which the first and second aligning members 208*a* and 208*b* do not come into contact with the sheet S. The target on which a staple process is performed may be a single sheet S.

The configuration of the sheet discharge option apparatus 200 will be further described with reference to FIG. 1. When the sheet S is guided in the direction of the conveyance path 212, the sheet S is discharged to a sheet discharge tray 215 by a sheet discharge roller 213. The presence or absence of the sheet S is detected by a conveyance sensor 218 (sheet detection unit) on the conveyance path 212. When a full state of the sheets S discharged to the sheet discharge tray 215 is detected by a full-state detection lever 214, the sheet discharge option apparatus 200 does not discharge the sheet S to the sheet discharge tray 215 until the sheets S on the sheet discharge tray 215 are removed. As described above, the sheet discharge option apparatus 200 includes a plurality of sheet discharge bins, i.e., the sheet discharge tray 211 and the sheet discharge tray 215, and can sort and allocate sheets S to different trays.

The sheet discharge option apparatus 200 is also provided with a door 222 to release the inside of the apparatus. The user can open the door 222 and remove a sheet S remaining inside the sheet discharge option apparatus 200.

Figure 5:
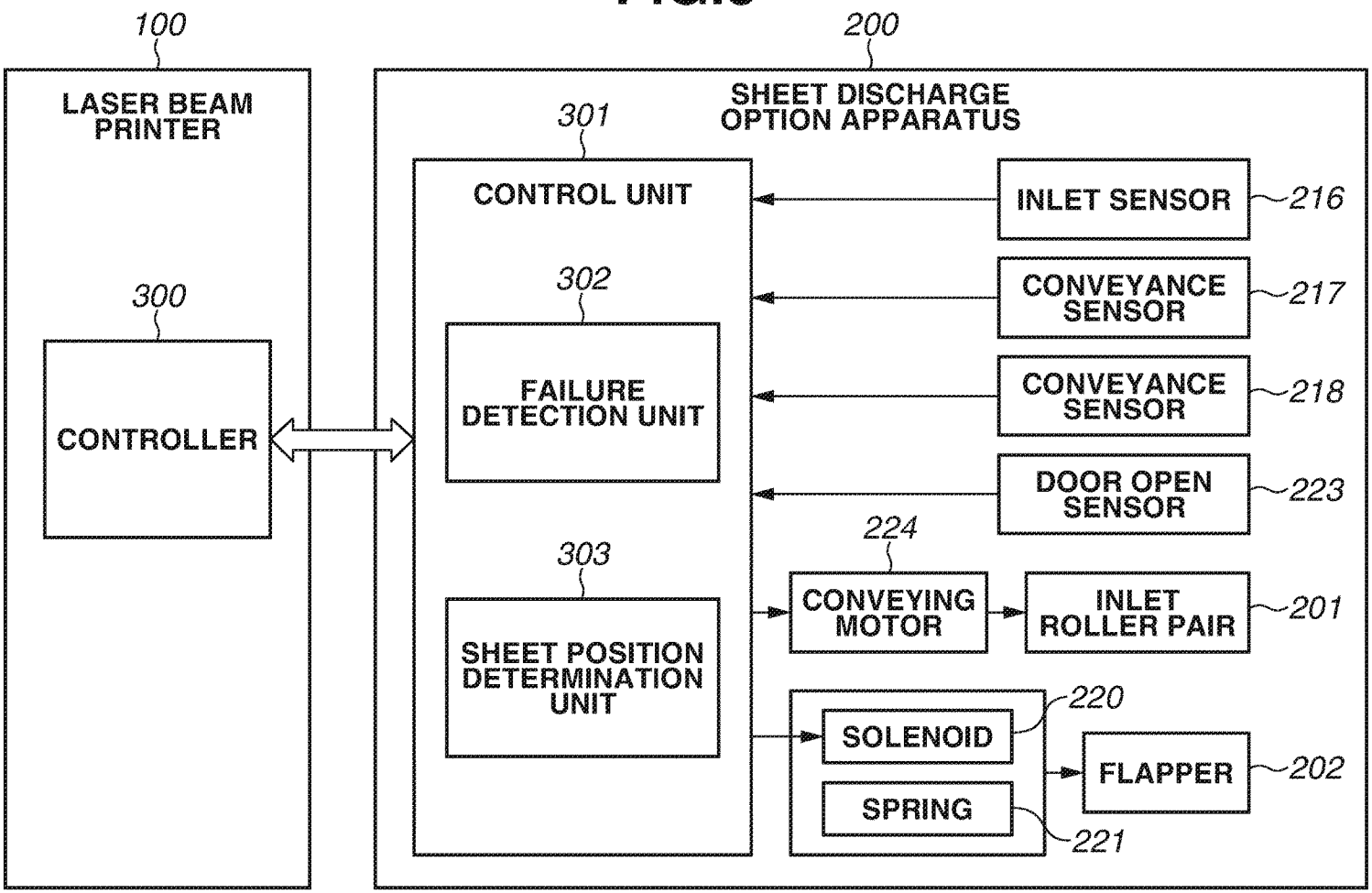
FIG. 5 is a control block diagram in a first example embodiment.

FIG. 5 is a control block diagram of the printer 100 and the sheet discharge option apparatus 200 in the present example embodiment. The printer 100 includes a controller 300 and the sheet discharge option apparatus 200 includes a control unit 301 (central processing unit (CPU)). The controller 300 and the control unit 301 are connected via a communication line. The control unit 301 of the sheet discharge option apparatus 200 includes a failure detection unit 302 and a sheet position determination unit 303.

The controller 300 receives information about a print job by performing communication with external devices (not illustrated), such as computers, and sends the received information to the control unit 301. The information about a print job is information indicating a conveyance destination of a sheet S, i.e., whether to send a sheet S to the sheet discharge tray 211 or the sheet discharge tray 215. Based on the information, the control unit 301 controls the solenoid 220 to switch the position of the flapper 202.

The inlet sensor 216, the conveyance sensor 217, and the conveyance sensor 218 are connected to the control unit 301. The failure detection unit 302 of the control unit 301 is notified of detection results by these sensors. Further, a door open sensor 223 (door detection unit) that detects opening of the door 222 is connected to the control unit 301. Based on detection results by these sensors, the failure detection unit 302 detects an occurrence of an abnormal state regarding the sheet discharge option apparatus 200. The abnormal state regarding the sheet discharge option apparatus 200 is, for example, a state in which a sheet S is jammed (paper clogging) or a state in which the door 222 is open when the door 222 should be closed.

The failure detection unit 302 can detect a state in which a sheet S is jammed, based on various sensors, such as the inlet sensor 216, the conveyance sensor 217, and the conveyance sensor 218. More specifically, if the various sensors do not detect a sheet even after a first predetermined time passes, the failure detection unit 302 determines that a delay jam of a sheet S has occurred somewhere before the sheet S reaches the various sensors. If a sheet S is detected by a sensor and the detection state of the sensor does not change even after a second predetermined time passes, the failure detection unit 302 determines that a retaining jam of a sheet S has occurred on the sensor. If the door open sensor 223 detects opening of the door 222 when the door 222 should be in a closed state while the sheet discharge option apparatus 200 conveys a sheet S, the failure detection unit 302 can detect an abnormally open state of the door 222. Then, in response to the detection of the occurrence of abnormal state by the failure detection unit 302, the control unit 301 turns off a conveying motor 224 to stop a conveyance operation of the sheet S by the inlet roller pair 201.

The sheet position determination unit 303 determines a position of a sheets S remaining inside the sheet discharge option apparatus 200 using the various sensors, i.e., the inlet sensor 216, the conveyance sensor 217, and the conveyance sensor 218. Then, when the position of the remaining sheet S is determined to be near a branch point of the conveyance path 219 by the sheet position determination unit 303, the control unit 301 controls the solenoid 220 to prevent the flapper 202 from being an obstacle to removal of the remaining sheet. The branch point of the conveyance path 219 is a branch point where the conveyance path 219 branches to the conveyance path 212 and the conveyance path 204. The details will be described below with reference to a flowchart.

Figure 6:
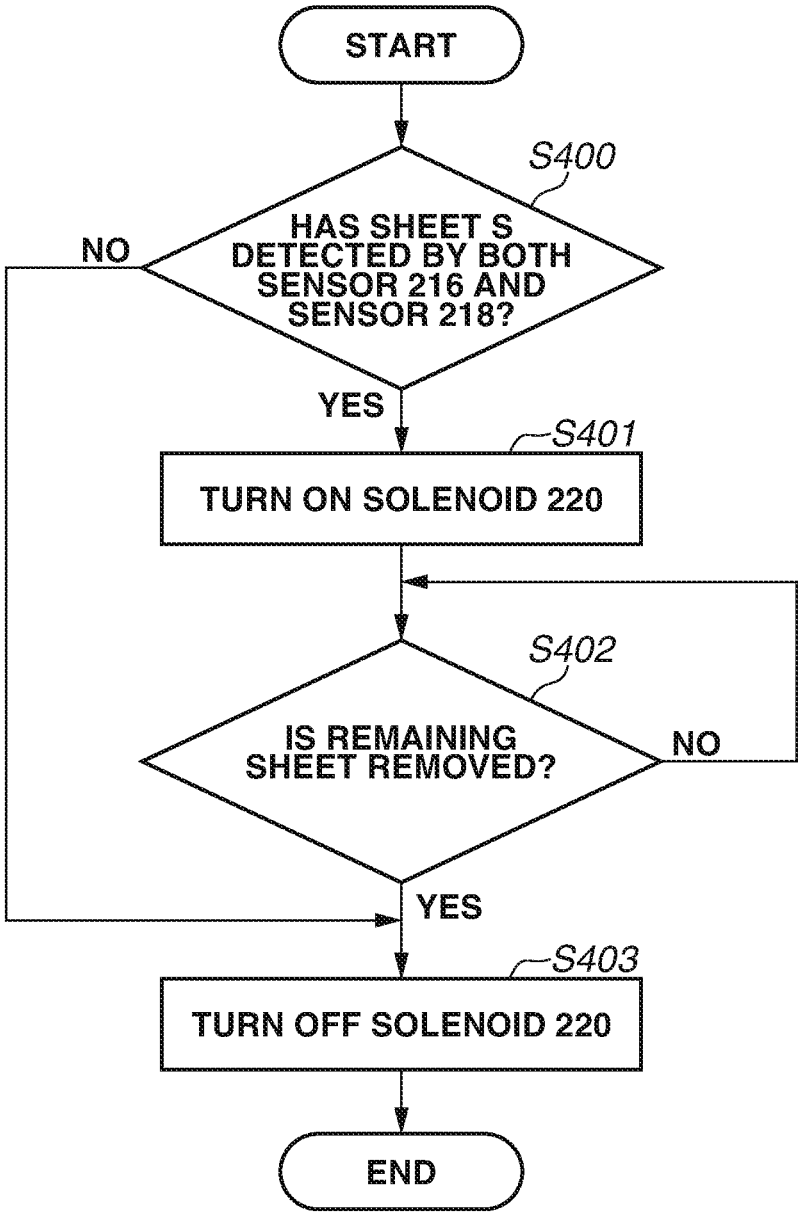
FIG. 6 is a flowchart when an abnormal state is detected in the first example embodiment.
Figure 7:
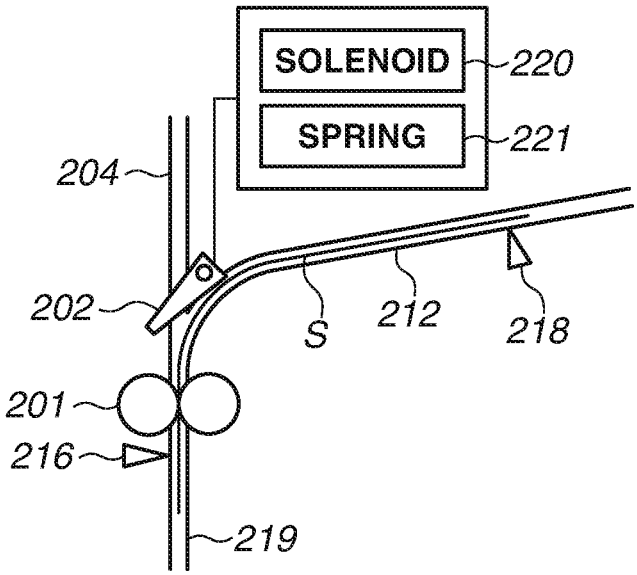
FIG. 7 is a diagram illustrating an example in which both of two sensors detect a sheet.

In the configuration described above, the operation of the sheet discharge option apparatus 200 in the present example embodiment will be described based on a flowchart illustrated in FIG. 6. The control based on the procedure of the flowchart illustrated in FIG. 6 is executed by the control unit 301 according to a program stored in a read-only memory (ROM) or the like.

The procedure of the flowchart is performed in the following case. The solenoid 220 receives power supply and the flapper 202 is in the position illustrated in FIG. 2A, and also, the failure detection unit 302 detects an occurrence of abnormal state while the conveyance path 212 conveys a sheet S. In response to the detection of the occurrence of abnormal state, actuators (such as the conveying motor 224) other than the solenoid 220 are turned off and the conveyance operation of the sheet S is stopped.

In step S400, the sheet position determination unit 303 checks detection results of the inlet sensor 216 installed on the conveyance path 219 and the conveyance sensor 218 installed on the conveyance path 212. In a case where both the inlet sensor 216 and the conveyance sensor 218 detect the sheet S (YES in step S400), the sheet position determination unit 303 determines that the sheet S stops at a position where the sheet S extends over the conveyance path 219 and the conveyance path 212 (near the branch point of the conveyance path 219). In this case, if the solenoid 220 is turned off, the flapper 202 traps the sheet S. Thus, in step S401, the control unit 301 continues to supply power to the solenoid 220 to maintain the solenoid 220 in an on state. The flapper 202 is thus controlled not to move to the position illustrated in FIG. 2B. Consequently, the flapper 202 does not trap the sheet S. In a case where the door 222 is opened, the control unit 301 also continues to supply power to the solenoid 220 to maintain the solenoid 220 in an on state. In step S402, the control unit 301 waits until the sheet S remaining inside the apparatus is removed. In response to a state in which neither the inlet sensor 216 nor the conveyance sensor 218 detects the sheet S, the control unit 301 determines that the remaining sheet S has been removed. In a case where the control unit 301 determines that the remaining sheet S has been removed (YES in step S402), the processing proceeds to step S403. In step S403, the control unit 301 stops the power supply to the solenoid 220 to turn off the solenoid 220, to save power consumption. Meanwhile, in step S400, one of the inlet sensor 216 and the conveyance sensor 218 does not detect the sheet S (NO in step S400), the control unit 301 determines that the sheet S does not stop at the position where the sheet S extends over the conveyance path 219 and the conveyance path 212. In this case, the processing proceeds to step S403. In step S403, the control unit 301 immediately turns off the solenoid 220. This completes the control of the flowchart.

As described above, according to the present example embodiment, a conveyance apparatus that improves usability by inhibiting the flapper 202 that switches a conveyance direction of a sheet S from becoming an obstacle to the user when a sheet S remaining inside the apparatus is removed can be provided.

In the first example embodiment, in a case where both of the inlet sensor 216 and the conveyance sensor 218 detect the sheet S, the sheet position determination unit 303 determines that the sheet S is in the position where the sheet S extends over the conveyance path 219 and the conveyance path 212. In a second example embodiment, the sheet position determination unit 303 can make a determination correctly in comparison with the first example embodiment by using more criteria for determining the position of the remaining sheet S than those of the first example embodiment. The description of the main portion is similar to that in the first example embodiment, and only a portion different from the first example embodiment will be described.

Figure 8:
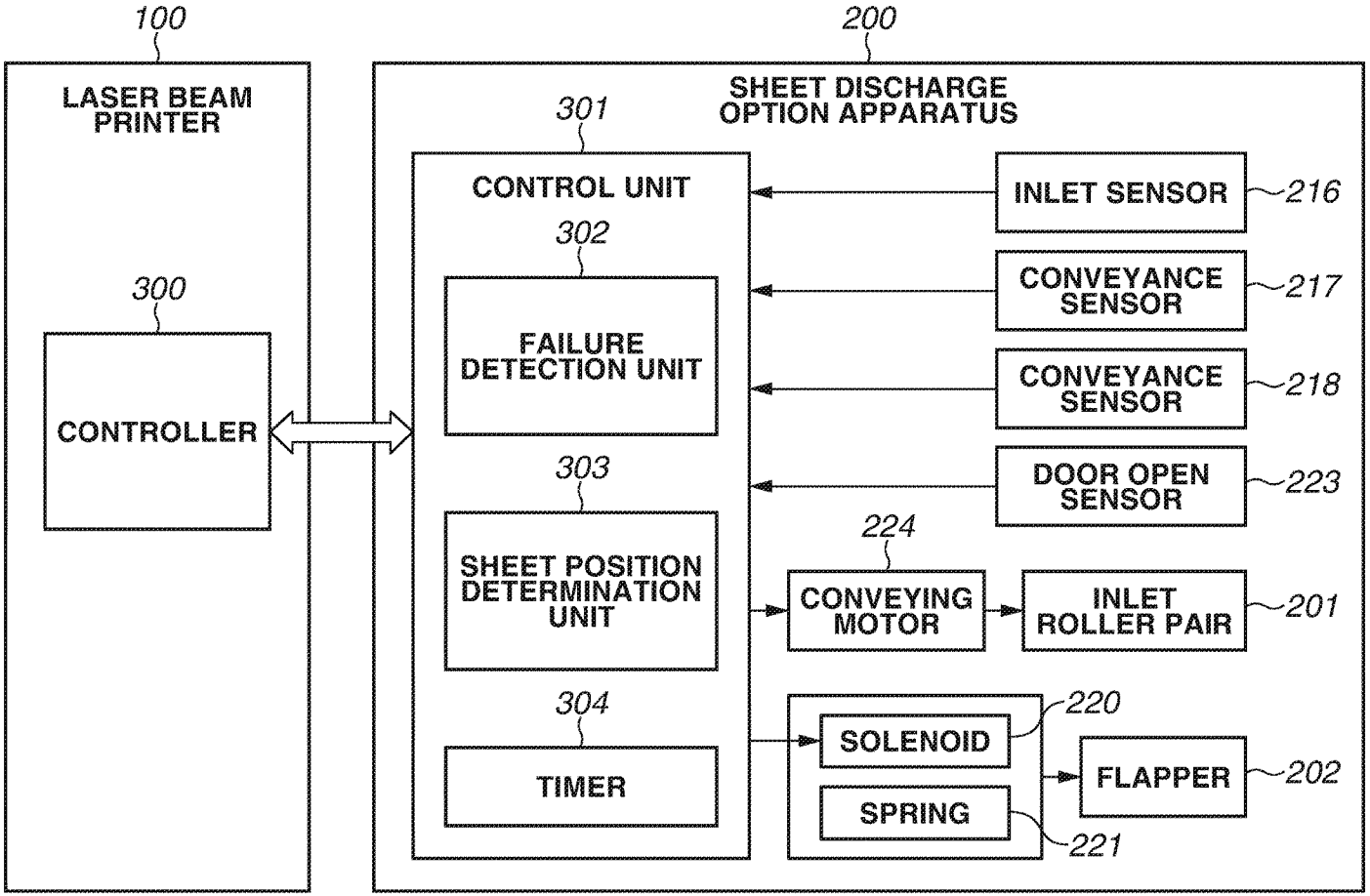
FIG. 8 is a control block diagram in a second example embodiment.

FIG. 8 is a control block diagram of the printer 100 and the sheet discharge option apparatus 200 in the present example embodiment. The control block diagram illustrated in FIG. 8 is different from that of FIG. 5 in that the control unit 301 of the sheet discharge option apparatus 200 includes a timer 304. In the present example embodiment, the timer 304 starts to count when the inlet sensor 216 detects a tip of a sheet S and resets the count value and restarts to count when the conveyance sensor 218 detects the tip of the sheet S. Then, the timer 304 finishes counting when the conveyance operation of the sheet S is stopped after the failure detection unit 302 detects an occurrence of abnormal state. The sheet position determination unit 303 determines the position of the remaining sheet S using the count value of the timer 304, in addition to detection results by the various sensors, i.e., the inlet sensor 216, the conveyance sensor 217, and the conveyance sensor 218.

Figure 9:
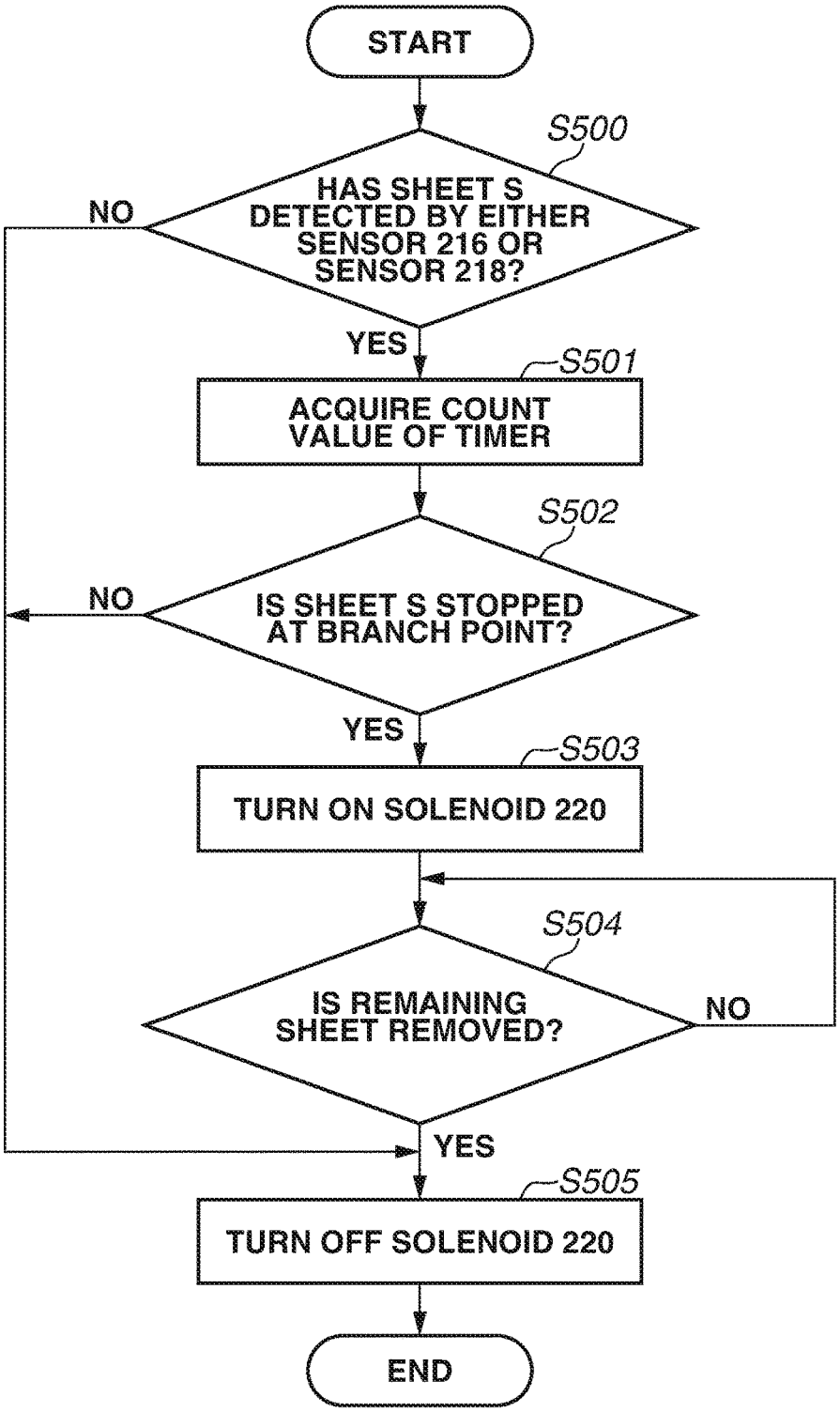
FIG. 9 is a flowchart when an abnormal state is detected in the second example embodiment.

In the configuration described above, the operation of the sheet discharge option apparatus 200 in the present example embodiment will be described with reference to a flowchart illustrated in FIG. 9. The control based on the procedure of the flowchart in FIG. 9 is executed by the control unit 301 according to a program stored in ROM or the like. The condition for performing the procedure of the flowchart are similar to those in the first example embodiment.

Figure 10A:
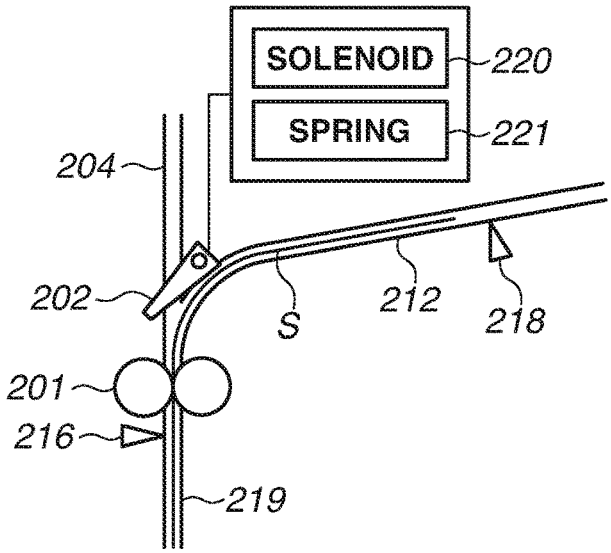
FIGS. 10A and 10B are diagrams illustrating an example in which either sensor detects a sheet.

In step S500, the sheet position determination unit 303 checks detection results of the inlet sensor 216 and the conveyance sensor 218. In a case where at least one of the two sensors detects a sheet S (YES in step S500), the processing proceeds to step S501. In step S501, the sheet position determination unit 303 acquires a count value from the timer 304. In step S502, the sheet position determination unit 303 determines how far the sheet S has been conveyed and where the sheet S is stopped, based on the count value from the timer 304 and the conveyance speed of the sheet S. In a case where, for example, the inlet sensor 216 detects the sheet S and the conveyance sensor 218 does not detect the sheet S, the sheet S may be in a state illustrated in FIG. 10A. The state illustrated in FIG. 10A is a state in which the tip of the sheet S has not yet reached the conveyance sensor 218, and a portion of the sheet S is positioned near the branch point of the conveyance path 219. Also, in a case where the inlet sensor 216 does not detect the sheet S and the conveyance sensor 218 detects the sheet S, the sheet S may be in a state illustrated in FIG. 10B. The state illustrated in FIG. 10B is a state in which the rear end of the sheet S has passed through the inlet sensor 216, and a portion of the sheet S is positioned near the branch point of the conveyance path 219.

Figure 10B:
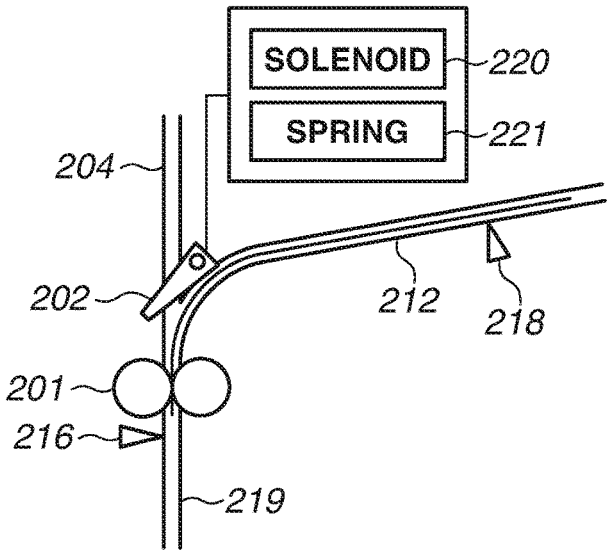

In a case where the sheet position determination unit 303 determines that, as illustrated in FIGS. 10A and 10B, the sheet S is stopped at the position where the sheet S extends over the conveyance path 219 and the conveyance path 212 (YES in step S502), the processing proceeds to step S503. In step S503, the control unit 301 continues to supply power to the solenoid 220 to maintain the solenoid 220 in an on state. In step S504, the control unit 301 waits until the sheet S remaining inside the apparatus is removed by the user. In response to a state in which the sensor which is either the inlet sensor 216 or the conveyance sensor 218 having detected the sheet S no longer detects the sheet S, the control unit 301 determines that the remaining sheet S has been removed. In a case where the control unit 301 determines that the remaining sheet S has been removed (YES in step S504), the processing proceeds to step S505. In step S505, the control unit 301 turns off the solenoid 220 to save power consumption. Meanwhile, in step S500, neither the inlet sensor 216 nor the conveyance sensor 218 detects the sheet S (NO in step S500), the control unit 301 determines that the sheet S is not stopped at the position where the sheet S extends over the conveyance path 219 and the conveyance path 212. In this case, the processing proceeds to step S505. In step S505, the control unit 301 immediately turns off the solenoid 220. In step S502, in a case where the sheet position determination unit 303 determines that the sheet S is not stopped at the position where the sheet S extends over the conveyance path 219 and the conveyance path 212 (NO in step S502), the processing also proceeds to step S505. In step S505, the control unit 301 stops the power supply to the solenoid 220 to turn off the solenoid 220. This completes the control of the flowchart.

As described above, according to the present example embodiment, the position where the sheet S is stopped can be determined accurately in comparison with the first example embodiment. A conveyance apparatus that improves usability by inhibiting the flapper 202 that switches the conveyance direction of the sheet S from becoming an obstacle to the user when the sheet S remaining inside the apparatus is removed can be provided.

In the first and second example embodiments described above, the control unit 301 determines whether to maintain the solenoid 220 in an on state based on detection results of the inlet sensor 216 and the conveyance sensor 218. However, the first and second example embodiments are not limited to such a configuration. The control unit 301 may maintain the solenoid 220 in an on state only based on information indicating that the sheet S is being conveyed toward the sheet discharge tray 215, regardless of detection results of the various sensors.

The stopped position of the sheet S may be determined without using the various sensors that detect a sheet S. For example, a timer that starts a measuring operation from a start of driving of the registration roller 110 to count the time in which a sheet S is conveyed may be provided and a position where a sheet S is stopped may be determined based on the measured value of the timer.

In the first and second example embodiments described above, the position of the flapper 202 is switched by operating the solenoid 220, but the first and second example embodiments are not limited to such a configuration. A stepping motor may be adopted to switch the position of the flapper 202. When the power supply to the stepping motor is stopped and the stepping motor is turned off, the force retaining the flapper 202 in the position illustrated in FIG. 2A is lost. In such a case, the flapper 202 may move, under the influence of gravity or the like, to the position illustrated in FIG. 2B where the flapper 202 traps the sheet S. Thus, in a case where the sheet position determination unit 303 determines that the sheet S is stopped at the position where the sheet S extends over the conveyance path 219 and the conveyance path 212, the control unit 301 continues the power supply to the stepping motor to maintain the stepping motor in an on state. Maintaining the stepping motor in an on state is such a control that power supply for a specific phase is continuously performed to maintain a position of a rotor at the current position and is different from such a control that the rotor is rotated by switching a phase for which power is supplied.

Also, in the configuration using a stepping motor, the flapper 202 may be configured to be able to move to three positions or more. For example, the flapper 202 moves to the position illustrated in FIG. 2A, the position illustrated in FIG. 2B, and further, a retreating position where the flapper 202 does not come into contact with a sheet S. The retreating position is a position where the flapper 202 does not become an obstacle to the user when removing a sheet S in the following both cases: a case where the sheet S is stopped at a position where the sheet S extends over the conveyance path 219 and the conveyance path 204 and a case where the sheet S is stopped at the position where the sheet S extends over the conveyance path 219 and the conveyance path 212.

In the first and second example embodiments described above, when a sheet jam occurs inside the sheet discharge option apparatus 200 and the door 222 of the sheet discharge option apparatus 200 is open, the failure detection unit 302 determines that an abnormal state has occurred. However, the determination is not limited to the case where an abnormal state occurs in the sheet discharge option apparatus 200. The failure detection unit 302 may also determine that an abnormal state has occurred when a sheet jam occurs inside the printer 100 and a door of the printer 100 is open.

In the first and second example embodiments, the configuration is described using the sheet discharge option apparatus 200 removably mounted on the printer 100. However, the first and second example embodiments are not limited to such a configuration. The flapper control may be adopted in a sheet conveyance mechanism in which the sheet discharge option apparatus 200 is fixed to and integrated with the printer 100.

In the first and second example embodiments, the above-described control is executed by the control unit 301 provided in the sheet discharge option apparatus 200. Alternatively, the sheet discharge option apparatus 200 may be configured to be controlled by a control unit provided in the printer 100.

In the first and second example embodiments described above, the sheet discharge option apparatus 200 is used as an example of a conveyance apparatus that conveys the sheet S. The conveyance apparatus may also be a reversing path or a two-sided path of an image forming apparatus or a document conveyance path of a document reading apparatus.

According to the example embodiments of the disclosure, as described above, a conveyance apparatus that improves usability by inhibiting the flapper 202 that switches a conveyance direction of a sheet S from becoming an obstacle to the user when the sheet S remaining inside the apparatus is removed can be provided.

As an alternative to the above-described configuration, the following configuration can be also considered: the curvature of the conveyance path is set as small as possible and the force with which the flapper 202 traps the sheet S is made small, so that the flapper 202 does not become an obstacle to the user when the remaining sheet S is removed. However, the sheet discharge option apparatus 200 increases in size in such a configuration. In contrast, the present example embodiments eliminate the need to make the curvature of the conveyance path small. Therefore, the sheet discharge option apparatus 200 can be downsized according to the present example embodiments.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-150424, filed Jul. 29, 2016, which is hereby incorporated by reference herein in its entirety.

What is claimed is:

1. A conveyance apparatus comprising:

a conveyance unit configured to convey a sheet along a predetermined conveyance path;

a flapper configured to be movable between a first position and a second position, the flapper in the first position guiding a sheet conveyed by the conveyance unit from the predetermined conveyance path to a first conveyance path branched from the predetermined conveyance path, the flapper in the second position guiding a sheet conveyed by the conveyance unit from the predetermined conveyance path to a second conveyance path branched from the predetermined conveyance path;

a flapper moving unit configured to move the flapper to the first position when power is supplied to the flapper moving unit, wherein when power supply to the flapper moving unit is stopped, the flapper moves to the second position;

a detection unit configured to detect an occurrence of an abnormal state relating to the conveyance apparatus; and a control unit configured to, in a case where the detection unit detects the occurrence of the abnormal state while a sheet is conveyed to the first conveyance path by the conveyance unit and the flapper is in the first position, stop a sheet conveyance operation of the conveyance unit and inhibit the flapper from moving to the second position by continuing to supply power to the flapper moving unit in a state where a remaining sheet is stopped at a position where the remaining sheet extends over the predetermined conveyance path and the first conveyance path.

2. The conveyance apparatus according to claim 1, further comprising:

a determination unit configured to determine a position of the sheet conveyed by the conveyance unit, wherein in a case where the determination unit determines that a remaining sheet is stopped at a position where the remaining sheet extends over the predetermined conveyance path and the first conveyance path, the control unit continues to supply power to the flapper moving unit, and in a case where the determination unit determines that the remaining sheet is not stopped at the position, the control unit stops power supply to the flapper moving unit.

3. The conveyance apparatus according to claim 2, further comprising:

a first sheet detection unit configured to detect a sheet on the predetermined conveyance path; and a second sheet detection unit configured to detect a sheet on the first conveyance path, wherein the control unit changes whether to continue to supply power to the flapper moving unit or to stop power supply to the flapper moving unit, based on detection results of the first sheet detection unit and the second sheet detection unit in a state in which the sheet conveyance operation of the conveyance unit is stopped.

4. The conveyance apparatus according to claim 3, wherein the control unit continues to supply power to the flapper moving unit in a case where both of the first sheet detection unit and the second sheet detection unit detect the sheet, and the control unit stops power supply to the flapper moving unit in a case where at least one of the first sheet detection unit and the second sheet detection unit does not detect the sheet.

5. The conveyance apparatus according to claim 3, further comprising:

a timer configured to count a time in which the sheet is conveyed by the conveyance unit, wherein in a case where at least one of the first sheet detection unit and the second sheet detection unit detects the sheet, the control unit changes whether to continue to supply power to the flapper moving unit or to stop power supply to the flapper moving unit, based on a count value of the timer and a conveyance speed of the sheet by the conveyance unit.

6. The conveyance apparatus according to claim 2, further comprising:

a timer configured to count a time in which the sheet is conveyed by the conveyance unit, wherein the control unit changes whether to continue to supply power to the flapper moving unit or to stop power supply to the flapper moving unit, based on a count value of the timer and a conveyance speed of the sheet by the conveyance unit.

7. The conveyance apparatus according to claim 1, wherein the flapper moving unit includes a solenoid and an elastic member, and wherein when power is supplied to the solenoid, the solenoid operates and moves the flapper to the first position, and when power supply to the solenoid is stopped, the flapper moves to the second position due to an elastic force of the elastic member.

8. The conveyance apparatus according to claim 1, wherein the flapper moving unit includes a stepping motor, and wherein when power is supplied to the stepping motor, the stepping motor operates and moves the flapper to the first position, and when power supply to the stepping motor is stopped, the flapper moves to the second position due to gravity on the flapper.

9. The conveyance apparatus according to claim 1, wherein the detection unit includes a sheet detection unit configured to detect a sheet which is conveyed, and wherein the abnormal state is a state in which the sheet detection unit remains in a state not detecting a sheet after a first predetermined time passes or a state in which the sheet detection unit remains in a state detecting a sheet after a second predetermined time passes.

10. The conveyance apparatus according to claim 1, wherein the detection unit includes a door detection unit configured to detect opening of a door to release the inside of the conveyance apparatus, and wherein the abnormal state is a state in which the door detection unit detects opening of the door while the sheet is conveyed by the conveyance unit.

11. The conveyance apparatus according to claim 1, further comprising:

a door configured to open the predetermined conveyance path and the second conveyance path, wherein opening the door enables the remaining sheet to be taken out from inside the conveyance apparatus.

12. The conveyance apparatus according to claim 1, wherein the control unit inhibits the flapper from moving to the second position by continuing to supply power to the flapper moving unit so that the flapper does not trap the remaining sheet against the first conveyance path.

13. A conveyance apparatus comprising:

a conveyance unit configured to convey a sheet along a predetermined conveyance path;

a flapper configured to be movable between a first position and a second position, the flapper in the first position guiding a sheet conveyed by the conveyance unit from the predetermined conveyance path to a first conveyance path branched from the predetermined conveyance path, the flapper in the second position guiding a sheet conveyed by the conveyance unit from the predetermined conveyance path to a second conveyance path branched from the predetermined conveyance path;

a flapper moving unit configured to move the flapper to the first position when power is supplied to the flapper moving unit, wherein when power supply to the flapper moving unit is stopped, the flapper moves to the second position;

a determination unit configured to determine a position of a sheet conveyed by the conveyance unit; and a control unit configured to, in a case where a sheet conveyance operation of the conveyance unit is stopped and the determination unit determines that a remaining sheet is stopped at a position where the remaining sheet extends over the predetermined conveyance path and the first conveyance path, inhibit the flapper from moving to the second position by continuing to supply power to the flapper moving unit.

14. The conveyance apparatus according to claim 13, further comprising:

a door configured to open the predetermined conveyance path and the second conveyance path, wherein opening the door enables the remaining sheet to be taken out from inside the conveyance apparatus.

15. The conveyance apparatus according to claim 13, wherein the flapper moving unit includes a solenoid and an elastic member, and wherein when power is supplied to the solenoid, the solenoid operates and moves the flapper to the first position, and when power supply to the solenoid is stopped, the flapper moves to the second position due to an elastic force of the elastic member.

16. The conveyance apparatus according to claim 13, wherein the flapper moving unit includes a stepping motor, and wherein when power is supplied to the stepping motor, the stepping motor operates and moves the flapper to the first position, and when power supply to the stepping motor is stopped, the flapper moves to the second position due to gravity on the flapper.

17. The conveyance apparatus according to claim 13, wherein, in a case where the sheet conveyance operation of the conveyance unit is stopped and the determination unit determines that the remaining sheet is not stopped at the position, the control unit stops power supply to the flapper moving unit.

18. The conveyance apparatus according to claim 13, wherein the control unit inhibits the flapper from moving to the second position by continuing to supply power to the flapper moving unit so that the flapper does not trap the remaining sheet against the first conveyance path.

19. A conveyance apparatus comprising:

a conveyance unit configured to convey a sheet along a predetermined conveyance path;

a flapper configured to be movable between a first position and a second position, the flapper in the first position guiding a sheet conveyed by the conveyance unit from the predetermined conveyance path to a first conveyance path branched from the predetermined conveyance path, the flapper in the second position guiding a sheet conveyed by the conveyance unit from the predetermined conveyance path to a second conveyance path branched from the predetermined conveyance path;

a flapper moving unit configured to move the flapper to the first position when power is supplied to the flapper moving unit, wherein when power supply to the flapper moving unit is stopped, the flapper moves to the second position; and a control unit configured to, in a case where a sheet conveyance operation of the conveyance unit is stopped, inhibit the flapper from moving to the second position by continuing to supply power to the flapper moving unit in a state where a remaining sheet is stopped at a position where the remaining sheet extends over the predetermined conveyance path and the first conveyance path.

20. The conveyance apparatus according to claim 19, wherein the control unit inhibits the flapper from moving to the second position by continuing to supply power to the flapper moving unit so that the flapper does not trap the remaining sheet against the first conveyance path.

* * * * *